US005987845A

United States Patent [19]

Laronde

[11] Patent Number: 5,987,845

[45] Date of Patent: Nov. 23, 1999

[54] POST COVER WITH TONGUE AND GROOVE JOINT

[76] Inventor: Mark J. Laronde, 135 Union Boulevard, Kitchener, Ontario, Canada, N2M 2S3

[21] Appl. No.: 09/074,662

[22] Filed: May 8, 1998

[51] Int. Cl.[6] ..... E04C 3/36

[52] U.S. Cl. ..... 52/731.2; 52/732.1; 52/737.1; 52/737.4; 52/738.1; 52/591.1; 52/592.2

[58] Field of Search ..... 52/245, 591.1, 52/592.1, 731.2, 732.1, 737.4, 738.1, 737.1, 737.3

[56] References Cited

U.S. PATENT DOCUMENTS

| | | | |
|---|---|---|---|
| 230,829 | 8/1880 | Shear et al. | 52/245 |
| 731,742 | 6/1903 | Beaumont | 52/245 |
| 996,926 | 7/1911 | Harrington | 52/738.1 X |
| 1,367,511 | 2/1921 | Cathroe | 52/245 |
| 1,453,806 | 5/1923 | Nord | 52/245 |
| 2,036,363 | 4/1936 | Schaefer | 52/245 |
| 4,522,006 | 6/1985 | Plikuhn | 52/245 X |

*Primary Examiner*—Christopher T. Kent

*Attorney, Agent, or Firm*—R. Craig Armstrong

[57] ABSTRACT

The cover assembly is designed to surround exposed posts. The assembly includes a number of sections each with an inner surface, outer surface and two side edges, the side edges being angled relative to the inner surface and outer surface. The sections are configured to abut each other along their side edges so that when a number of sections are abutted they form a polygon with a hollow interior portion to accommodate the post. Each section has one side edge with a tongue projecting from it and extending the length thereof, and one side edge having a groove extending the length thereof configured to receive the tongue of an abutting section. Preferably the cover assembly is preassembled into two section assemblies each consisting of a number of sections previously bonded to each other such that the end user can place the two section assemblies around a post, place adhesive in the grooves of the exposed side edges of the section assemblies, press the section assemblies together so that they surround the post, and apply pressure, so that the section assemblies become fixed to each other. The tongues and grooves preferably are positioned closer to the inner surface than to the outer surface, so that any leakage of adhesive is less likely to make its way to the outer surface of the assembly.

9 Claims, 4 Drawing Sheets

POST COVER WITH TONGUE AND GROOVE JOINT

BACKGROUND OF THE INVENTION

This invention relates to assemblies used to cover posts or other elongate members. Such assemblies are typically used to surround posts in a decorative fashion, although their use is obviously not limited to that particular application. The invention relates to such assemblies used for various applications.

Residential structures often contain posts designed for structural support, located centrally within the building. As such, it is often the case that such posts are located in the middle of a room. The appearance of exposed posts in the middle of a room within a residence may have an adverse effect on aesthetic integrity. Accordingly, many homeowners attempt to restore aesthetic integrity of a room by surrounding the posts with a decorative assembly. The features and appearance of the assemblies vary depending on the nature of the room in which they will be located, i.e. the assembly will be designed to match the colors and other aesthetics of a given room.

Post cover assemblies commonly include separate sections, each with inner and outer surfaces and side edges. The side edges of each section are angled such that a number of them, when abutting each other, will create a polygon with a hollow interior portion, the hollow portion designed to accommodate the post or other member. Usually, these angled side edges have flat surfaces. The abutting side edges of the sections of the assembly are glued to each other. Typically, the assembly is assembled for the end user as follows: Several sections are abutted and bonded together to provide two section assemblies, each such section assembly usually consisting of an equal number of sections. When butted together, the two section assemblies completely surround the post. The end user can thus place the two section assemblies around the post, or other such elongate member, and press the sections together. Section assemblies will be affixed to each other with glue or other adhesive placed along the exposed side edges of the section assemblies. To ensure proper bonding of the section assemblies, the section assemblies are usually clamped around the member such that constant pressure is applied while the adhesive sets.

Cover assemblies including sections with flat side edges typically encounter at least two problems upon assembly. Firstly, abutting sections with flat side edges are difficult to align properly upon assembly. Secondly, when abutting sections with flat side edges are pressed together upon assembly of the sections, adhesive used to secure the bonds between abutting sections tend to be extruded from the joints out towards and often onto the outer surface of the cover assembly. This can adversely affect the appearance of the finished cover assembly, since any stain or other surface treatment does not absorb or adhere as well as if the adhesive did not make its way to the outer surface.

During the procedure of assembling the sections into a cover assembly, there is a need to ensure that abutting sections are properly aligned with each other when placing the assembly sections around the member. It is also desirable to control the leakage of adhesive used to secure abutting sections to each other, such that the outer surface of the assembly is not damaged by adhesive.

SUMMARY OF THE INVENTION

It follows from the above that it is an object of the invention to create a cover assembly having a means for improved alignment of sections, and at the same time providing a more secure joint.

It is also preferable to provide improved control of leakage of adhesive during assembly.

In the invention, a tongue and groove construction is employed, i.e. each section of the assembly has one side edge with a tongue projecting therefrom, and the other side edge has a complimentary groove configured to receive the tongue of the abutting section, thus ensuring proper alignment upon assembly. In the preferred embodiment of the invention, the tongue and groove are positioned and configured so as to avoid or limit leakage of adhesive onto the outer surface of the assembly, as will be explained in detail below.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
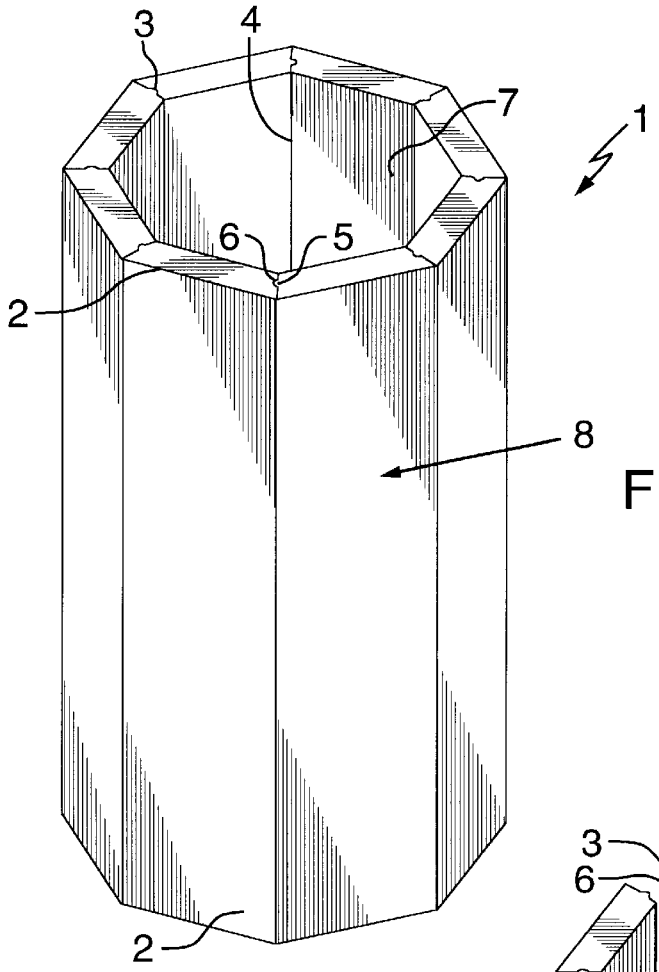
FIG. 1 is a perspective view of the preferred embodiment of the assembled cover assembly.

Referring to the drawings, FIGS. 1–5 show the preferred embodiment of the cover assembly 1, including sections 2, assembled together such that the side edges 3 of the sections are abutted against each other, creating a hollow central portion 4. In the preferred embodiment, eight sections are abutted against each other to create an octagon with a hollow central portion. Each section has one side edge with a tongue 5 extending along its length, and one side edge with a groove 6 extending along its length. The groove is configured and positioned to receive the tongue of the abutting section 2. When the tongue is inserted in the abutting groove, the inner surface 7 of each section and outer surface 8 of each section are flush with the inner surface and outer surfaces of abutting sections.

Figure 3:
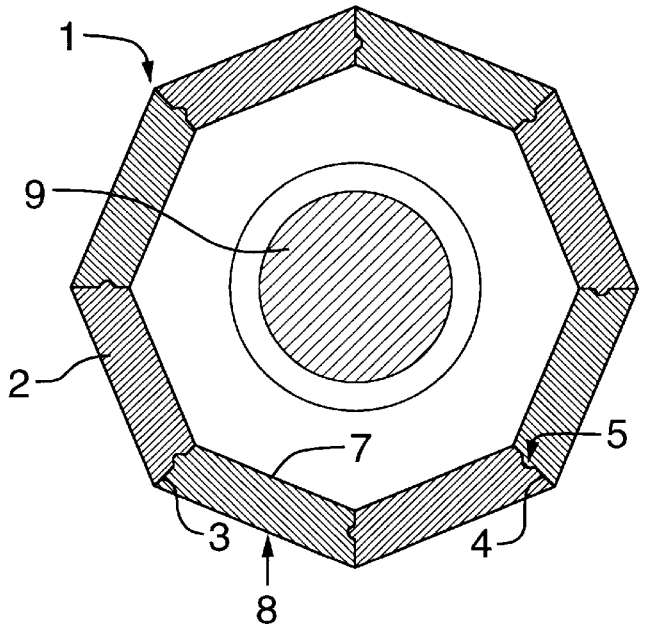
FIG. 3 is a cross section of the cover assembly, assembled around a post.
Figure 2:
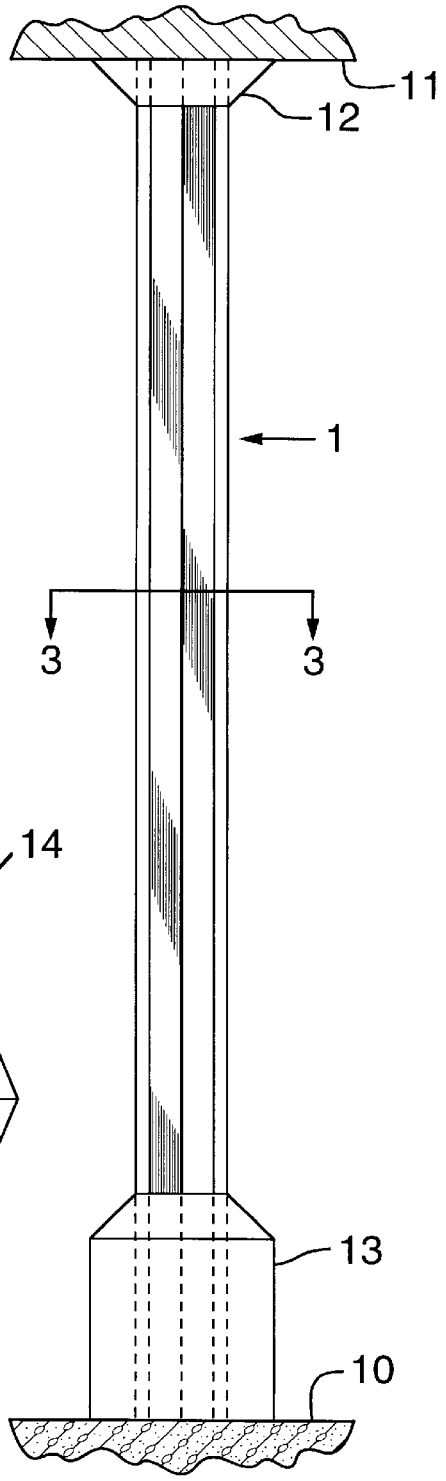
FIG. 2 is a side view of the cover assembly, assembled around a post, showing top and bottom pieces attached.

FIG. 2 shows the cover assembly assembled around a post 9, such that the post is completely surrounded by the cover assembly from floor 10 to ceiling 11. FIG. 3. also shows an optional top piece 12 surrounding and affixed to the outer surface of the cover assembly, functioning as a decorative bridge between the cover assembly and the ceiling. FIG. 3 also shows a lower piece 13 similarly surrounding and affixed to the outer surface of the cover assembly, as a decorative bridge between the cover assembly and the floor 10.

Figure 4:
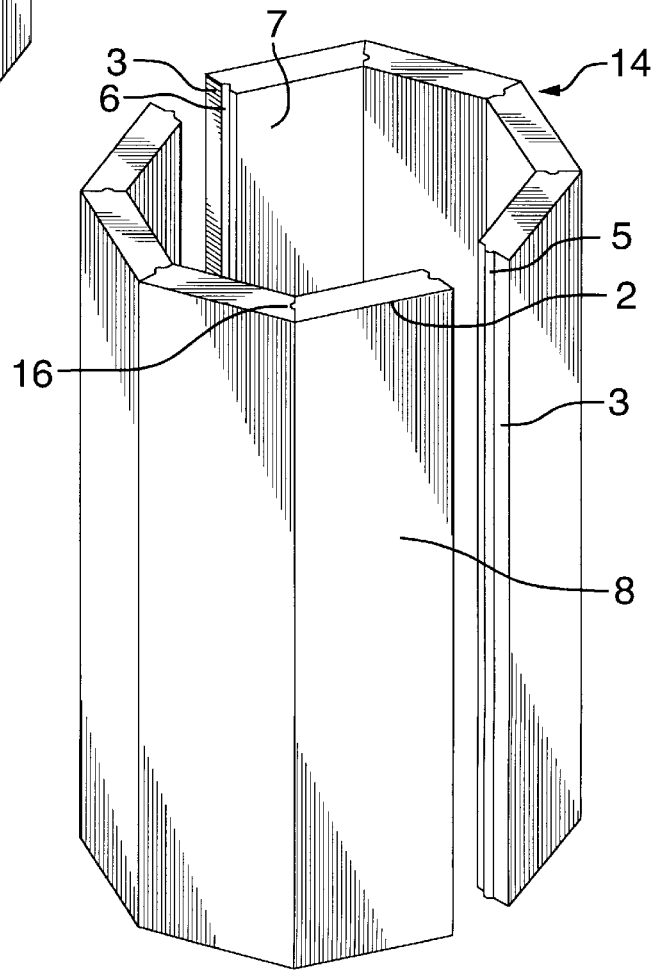
FIG. 4 is a perspective view of the cover assembly assembled into two section assemblies.
Figure 5:
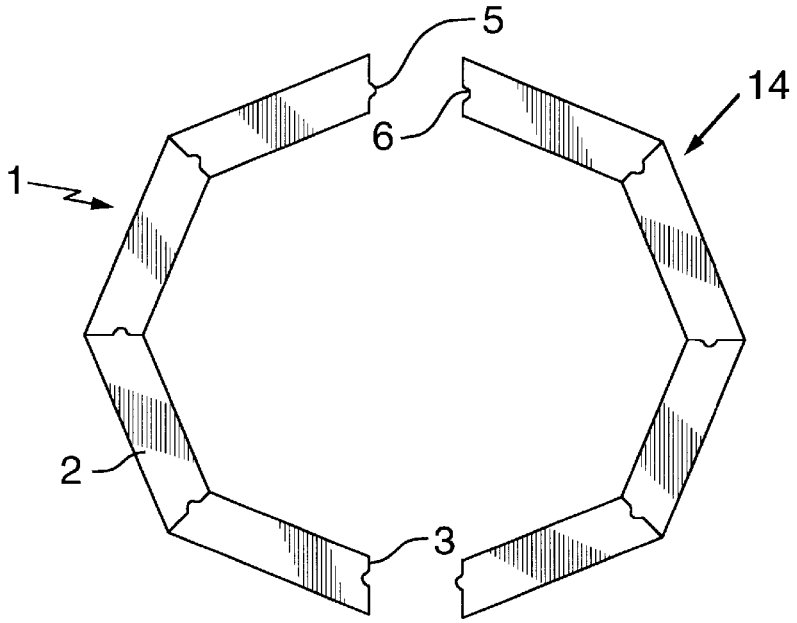
FIG. 5 is a top view of the cover assembly assembled into two section assemblies.

FIGS. 4–5 show the cover assembly preassembled for the end user into two section assemblies 14. Each section assembly is preassembled as follows: adhesive 15 is placed in each groove 5 of each section in the section assembly. Abutting sections are aligned so that the tongue of one section is inserted into the groove of the abutting section. Once the sections 2 of each section assembly 14 are abutted and constant pressure is applied, abutting sections become fixed to each other. Each section assembly has one exposed side edge with a tongue extending therefrom and one exposed side edge with a groove therein. In the preferred embodiment of the cover assembly, i.e. the octagonal shape, each section assembly includes four sections 2.

For final assembly around a post, the end user then inserts adhesive into the grooves of the exposed side edges of each section assembly. The end user then places the two section assemblies around the post and presses the exposed side edges of the section assemblies together such that the tongue of one exposed side edge is received by the groove of the exposed side edge of the other section assembly. Constant pressure is then applied to the tongue and groove joint 16 so as to create a bond.

Figure 8:
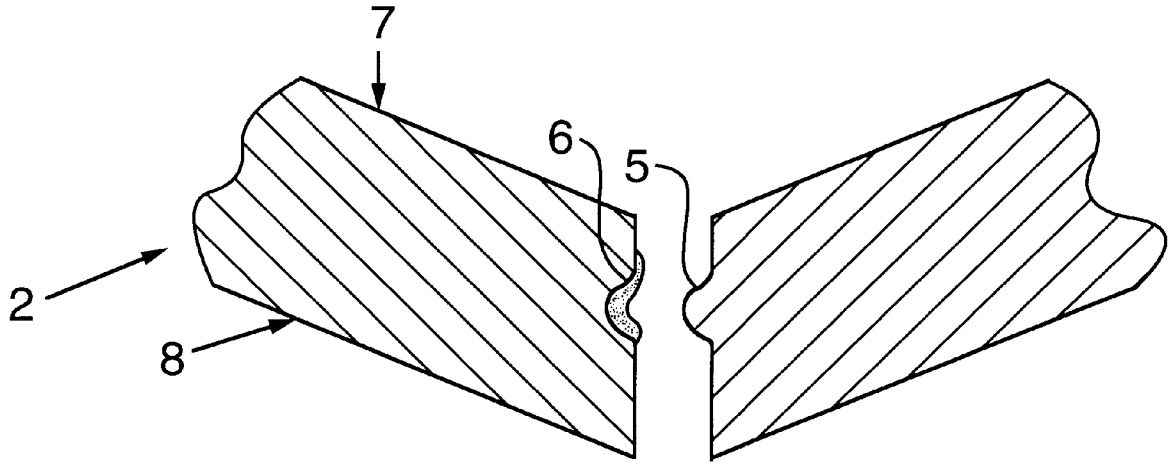
FIG. 8 is a close up top view of a tongue and groove joint of the cover assembly.
Figure 9:
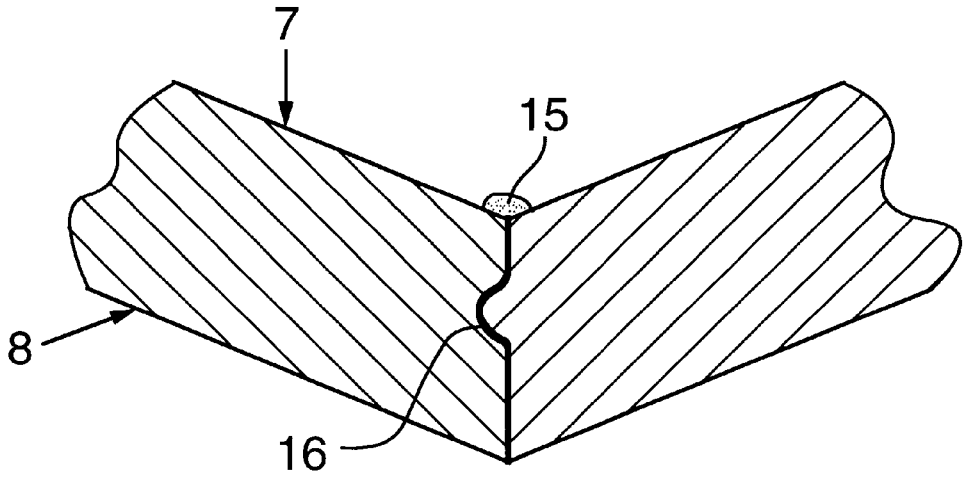
FIG. 9 is a close up top view of a tongue and groove joint of the cover assembly.

In the preferred embodiment of the cover assembly, the tongue and groove are positioned closer to the inner surface 7 of each section than the outer surface 8 of each section to control the leakage of adhesive 15 towards the inner surface 7 when abutting sections are pressed together for placement around a post. FIGS. 8–9 show close up top views of a tongue and groove joint 16 with adhesive applied to the groove and show that when abutting sections are pressed together, adhesive is more likely to leak toward the inner surface 7 than the outer surface 8, since the distance is shorter. In the preferred embodiment, the tongue and groove are positioned approximately ⅓ of the distance from the inner surface to the outer surface.

Figure 6:
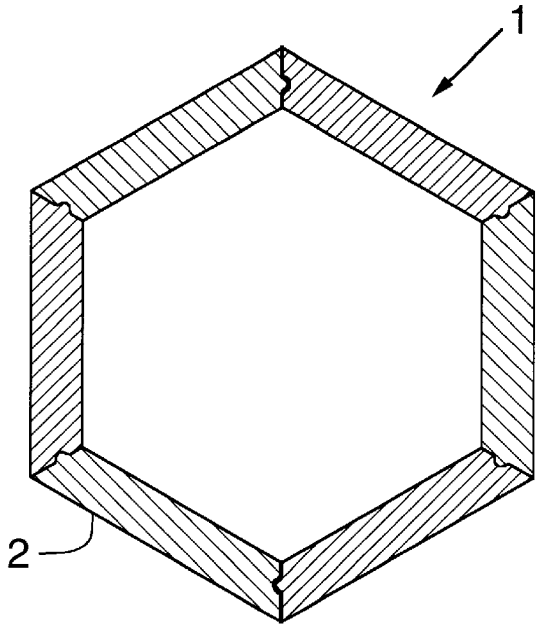
FIG. 6 is a top view of an alternative embodiment of the assembled cover assembly.

FIG. 6 shows an alternative embodiment of a cover assembly, similar to the preferred embodiment but including six sections 2.

Figure 7:
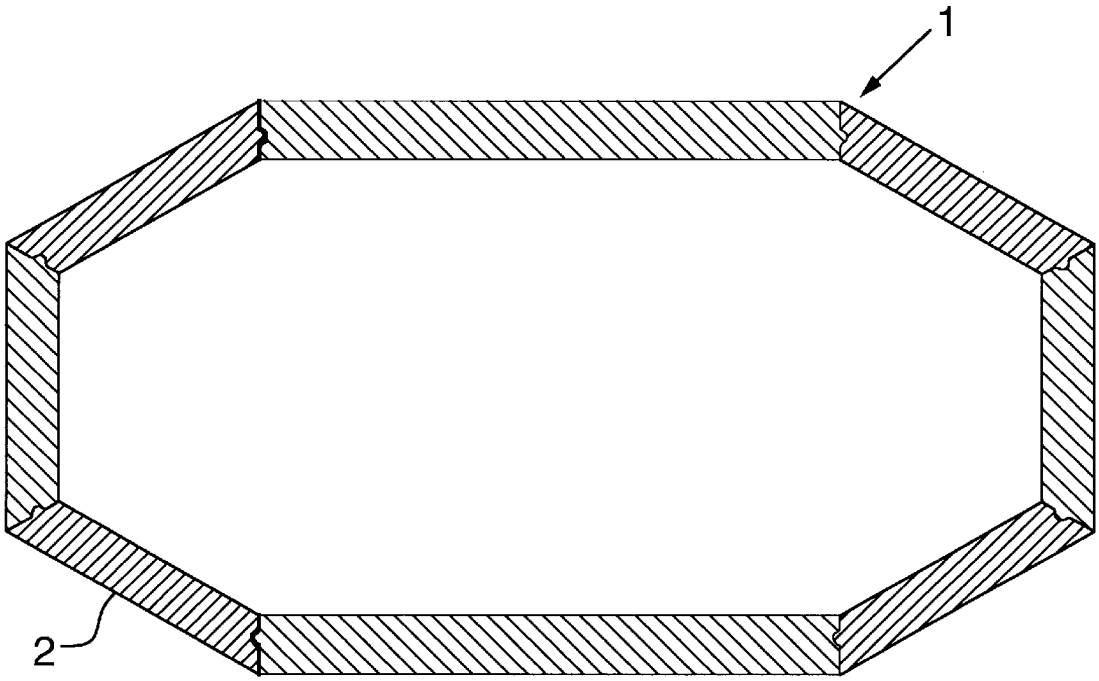
FIG. 7 is a top view of another alternative embodiment of the assembled cover assembly.

FIG. 7 shows another alternative embodiment of the cover assembly, similar to the preferred embodiment, but including eight sections 2, two of which are oriented on opposite sides of the cover assembly and are greater in length as measured from side edge to side edge than the other sections of the cover assembly.

It will further be appreciated that the above description relates to the preferred and alternative embodiments by way of example only. Many variations on the invention will be obvious to those knowledgeable in the field, and such obvious variations are within the scope of the invention as described and claimed, whether or not expressly described. For example, the tongue and groove need not necessarily be shaped as illustrated in the drawings. The tongue could be a pointed projection or tongue could be an oblong projection, for example, i.e. generally rectangular.

What is claimed as the invention is:

1. A cover assembly for surrounding an elongate member, said cover assembly comprising a plurality of successively abutting elongate sections, having inner and outer surfaces and side edges, said sections abutting each other along said side edges, said side edges being angled relative to said inner and outer surfaces such that said plurality of sections defines a polygon with a central hollow portion to accommodate said elongate member, and a polygon outer surface which is uninterrupted, one side edge of each section having a tongue projecting therefrom and extending the length thereof, the other side edge of each section having a groove therein extending the length thereof, configured to receive a said tongue of an abutting section, each said tongue and groove being positioned closer to said inner surface than said outer surface.

2. A cover assembly as recited in claim 1, where several of said sections are abutted and bonded to each other to provide two section assemblies, such that said two section assemblies define said polygon when abutted to each other along exposed side edges.

3. A cover assembly as recited in claim 2, where the two section assemblies each contain an equal number of sections.

4. A cover assembly as recited in claim 1, where said polygon is a regular polygon.

5. A cover assembly as recited in claim 4, where said regular polygon is a hexagon.

6. A cover assembly as recited in claim 4, where said regular polygon is an octagon.

7. A cover assembly as recited in claim 1, where said polygon comprises a plurality of said sections of equal dimensions, and two other said sections, oriented on opposite sides of said polygon, having a greater length as measured from side edge to side edge than said sections of equal dimension.

8. A cover assembly as recited in claim 1, where the distance of said tongue and groove from said inner surface is approximately one third of the distance from said inner surface to said outer surface of each section.

9. A cover assembly as recited in claim 1, where said tongue is a semicircular projection running the length of said side edge and the groove is configured to receive said tongue.

* * * * *